US008166893B2

(12) United States Patent
Davis

(10) Patent No.: US 8,166,893 B2
(45) Date of Patent: May 1, 2012

(54) TABLE SYSTEM

(75) Inventor: Edgar Davis, Surrey (CA)

(73) Assignee: Animal Marketing Inc., Surrey (CA)

( * ) Notice: Subject to any disclaimer, the term of this patent is extended or adjusted under 35 U.S.C. 154(b) by 259 days.

(21) Appl. No.: 12/576,208

(22) Filed: Oct. 8, 2009

(65) Prior Publication Data

US 2010/0175593 A1 Jul. 15, 2010

Related U.S. Application Data

(63) Continuation-in-part of application No. 29/194,829, filed on Dec. 3, 2003, now Pat. No. Des. 603,633.

(51) Int. Cl.
*A47B 85/00* (2006.01)

(52) U.S. Cl. ..... 108/90; 108/26

(58) Field of Classification Search ..... 108/25–26, 108/90

See application file for complete search history.

(56) References Cited

U.S. PATENT DOCUMENTS

| | | | | |
|---|---|---|---|---|
| 2,094,915 | A | 10/1937 | Dawson | |
| 3,828,695 | A * | 8/1974 | Skarky | 108/26 |
| 5,600,911 | A * | 2/1997 | Lucci | 40/611.1 |
| 6,065,466 | A * | 5/2000 | Baykal | 126/41 R |
| 6,161,333 | A | 12/2000 | Poston | |
| D439,446 | S * | 3/2001 | Harrison | D6/480 |
| 6,237,508 | B1 * | 5/2001 | Weiss | 108/26 |
| 6,321,662 | B1 * | 11/2001 | Fraise | 108/25 |
| D453,488 | S | 2/2002 | McCauley | |
| 6,474,244 | B1 * | 11/2002 | Karpinski | 108/42 |
| 6,823,804 | B2 | 11/2004 | Arnell | |
| 7,004,082 | B2 * | 2/2006 | Yang | 108/50.12 |
| 7,078,085 | B2 | 7/2006 | Nykamp et al. | |
| 7,290,490 | B2 * | 11/2007 | Goldberg et al. | 108/26 |
| 2004/0139892 | A1 * | 7/2004 | Giegerich | 108/26 |
| 2006/0150871 | A1 * | 7/2006 | Palmby | 108/90 |
| 2007/0056482 | A1 * | 3/2007 | Robinson et al. | 108/25 |
| 2007/0101909 | A1 * | 5/2007 | Poyorena | 108/90 |

* cited by examiner

*Primary Examiner* — Hanh V Tran
(74) *Attorney, Agent, or Firm* — Jeffer Mangels Butler & Mitchell LLP

(57) ABSTRACT

A table system that includes a table top having an upper surface and a surface covering which covers substantially the upper surface of the table top. The table top and the surface covering have concentric openings with substantially similar diameters.

5 Claims, 9 Drawing Sheets

TABLE SYSTEM

FIELD OF THE INVENTION

This invention is directed to a table system and more particularly to a table system having a table top, an opening on the surface of the table top, and a removable bucket contained in the opening.

SUMMARY OF THE PREFERRED EMBODIMENTS

In accordance with one aspect of the present invention, there is provided a table system. The table system includes a table top having a surface and an opening in the surface that has a diameter of at least about three inches.

In accordance with another aspect of the present invention, there is provided a surface covering for a table top. The surface covering has a planar portion covering substantially all of the table top. The planer portion preferably has a hole in it that has a diameter of at least about three inches.

In accordance with another aspect of the present invention, there is provided a table system. The table system includes a table top having an upper surface, a surface covering which covers substantially the upper surface of the table top. Preferably, the table top and the surface covering have concentric openings with substantially similar diameters.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION

Figure 1:
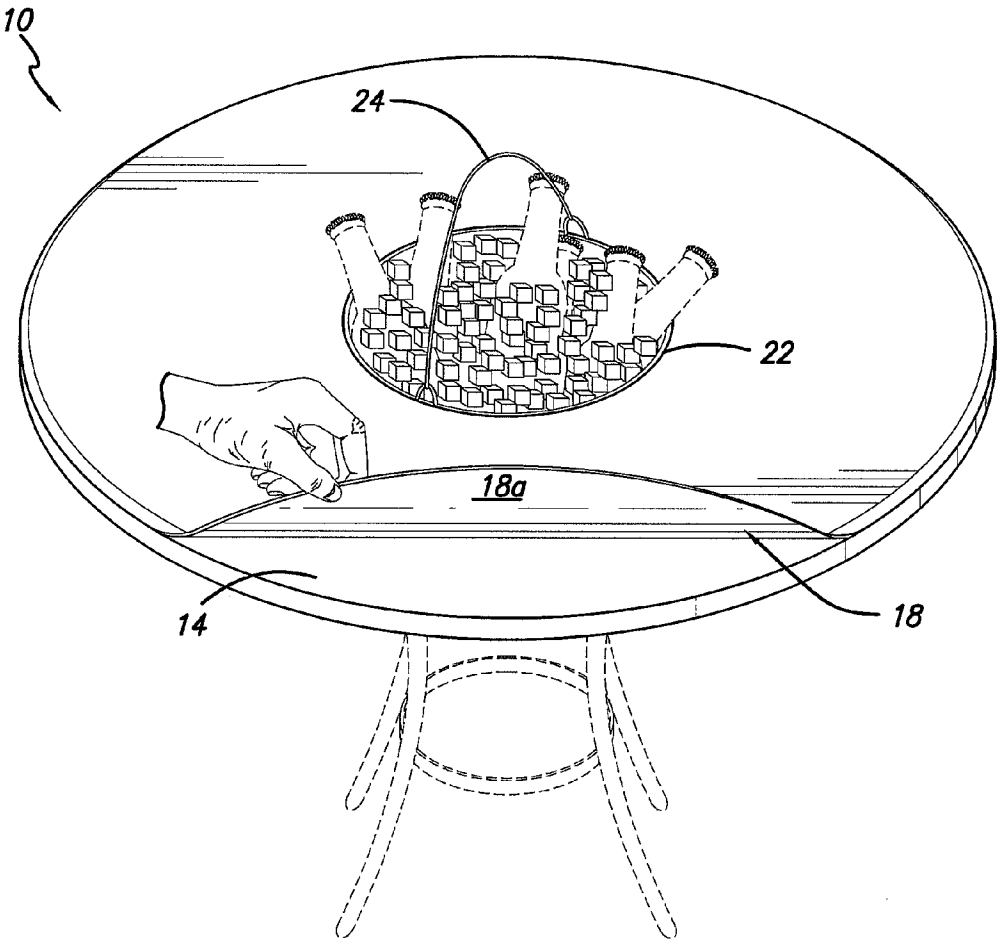
FIG. 1 is a perspective view of a table system in accordance with a preferred embodiment of the present invention.
Figure 2:
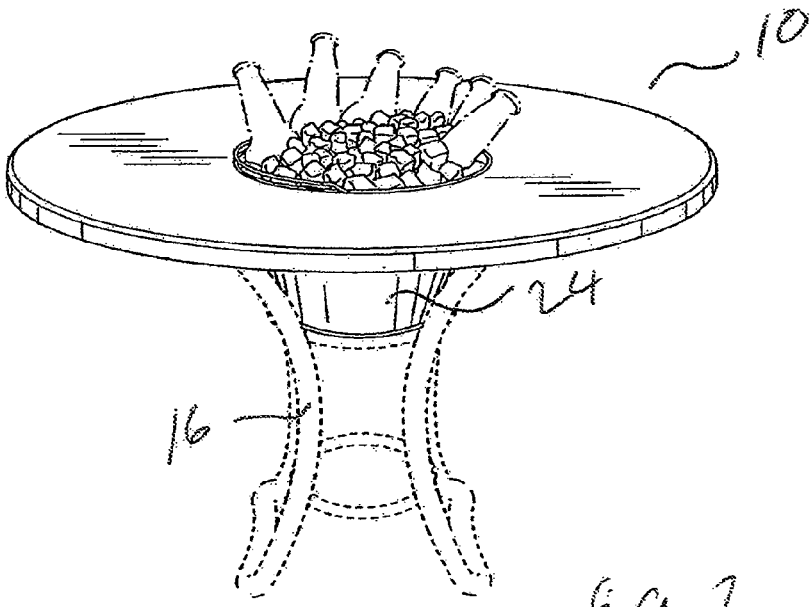
FIG. 2 is a perspective view of a table system of FIG. 1.
Figure 3:
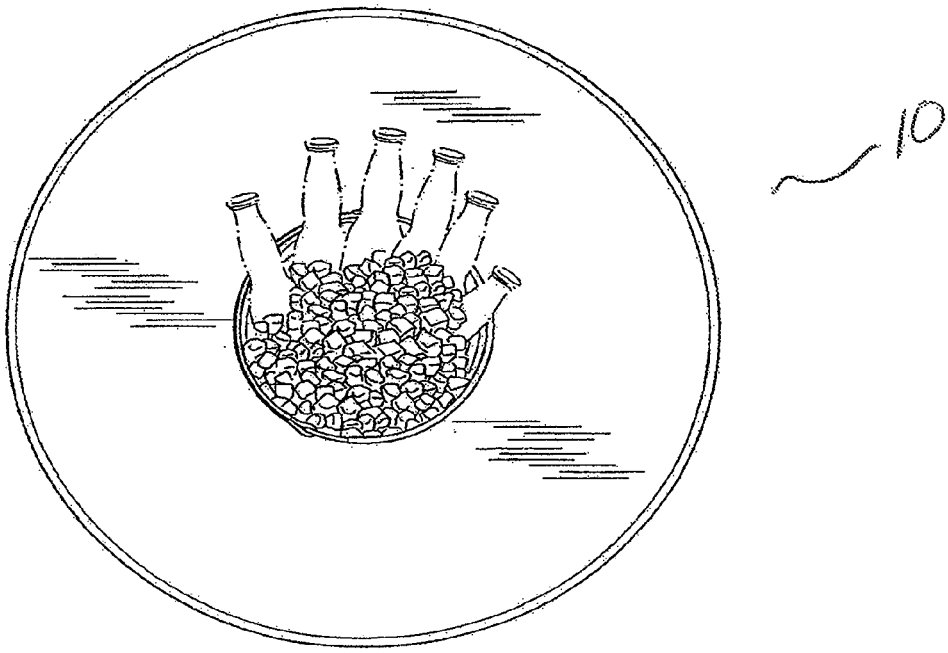
FIG. 3 is a top view of the table system of FIG. 1.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

As shown in FIGS. 1-11, the present invention is preferably directed to a table system 10 having a table top 12 having an outer edge, an upper surface 14 (best seen in FIGS. 1 and 8), a plurality of legs 16, and at least one table top opening 20 (as used herein, the numerical identifier "20" refers to a plurality of table top openings, i.e., at least one). Preferably, the upper surface 14 includes a removable surface covering 18. The table system 10 preferably includes at least one bucket 24 (as used herein, the numerical identifier "24" may refer to one bucket or more than one bucket) for holding a plurality of beer bottles (as used herein "bottles" or "beer products" may refer to "cans" of beer and/or any other commercial item).

Figure 10:
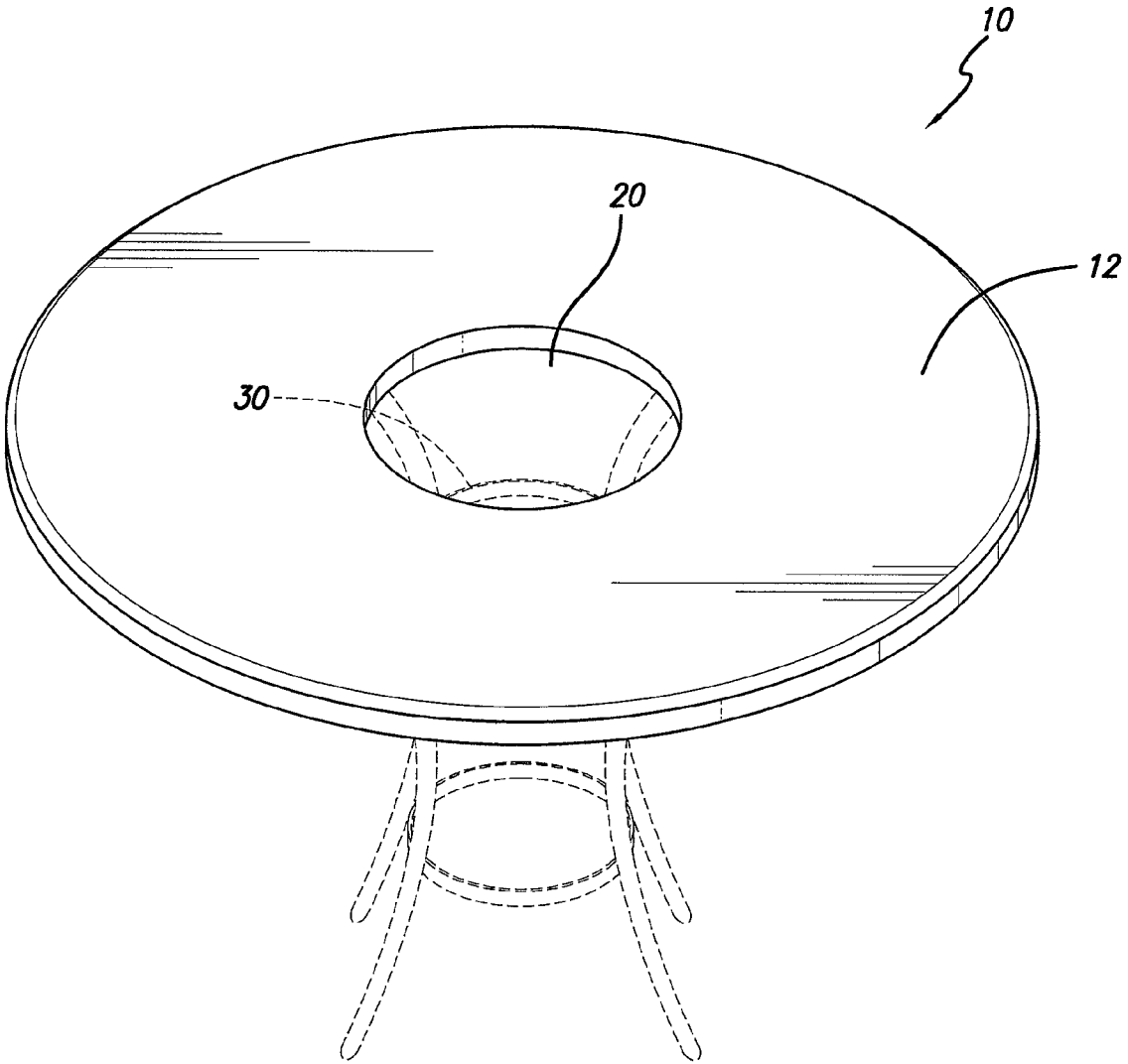
FIG. 10 is a perspective view of the table system of FIG. 1.
Figure 11:
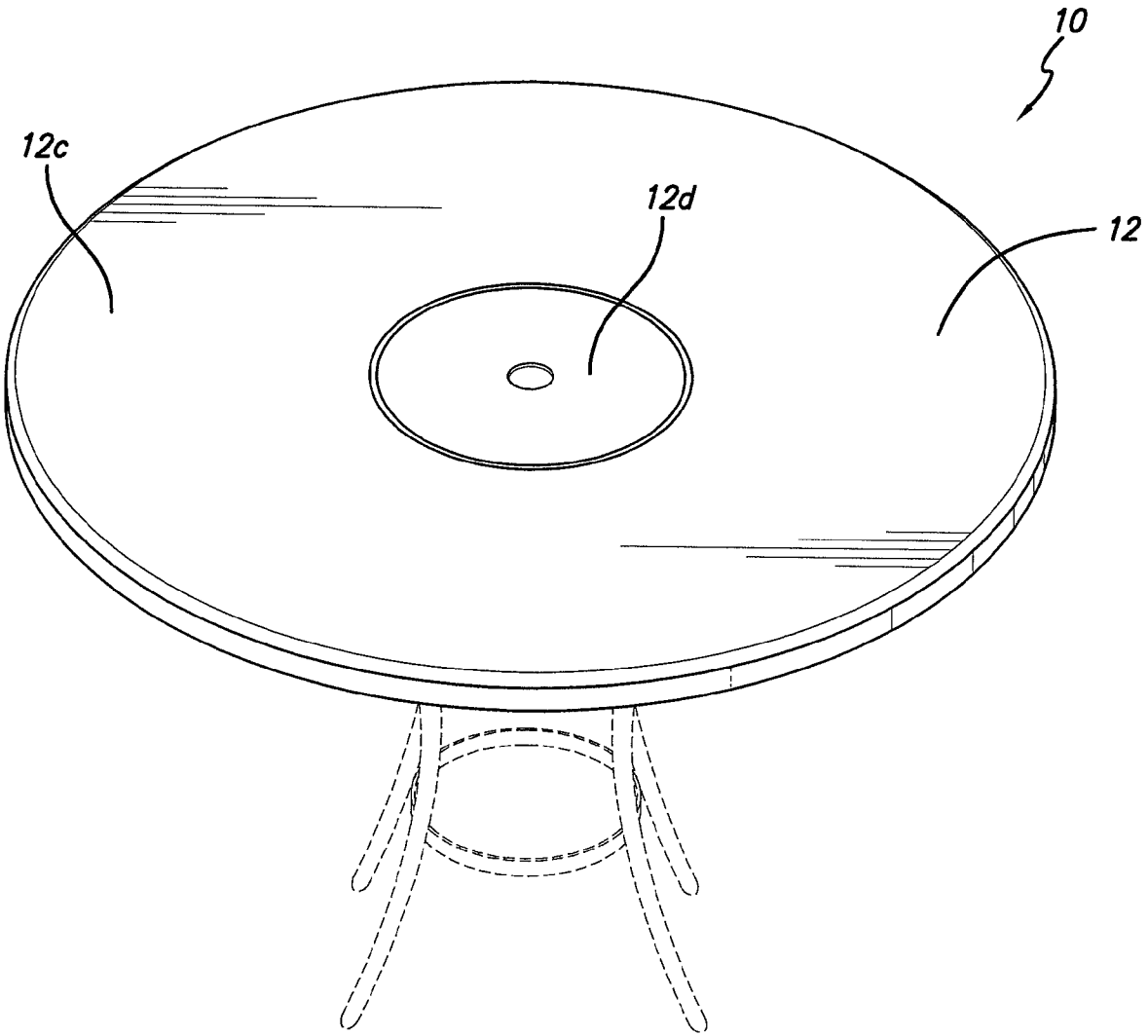
FIG. 11 is a perspective view of the table system of FIG. 1.

In a preferred embodiment, and as best seen in FIG. 11, the table top 12 includes a first portion 12*c* and a second portion 12*d* which are separable from each other. Referring now to FIG. 10, the first portion 12*c* preferably includes the table top opening 20. Removal of the second portion 12*d* exposes the table top opening 20. In other embodiments, first portion 12*c* and second portion 12*d* are not separable from each other. In yet other embodiments, table top 12 may not include second portion 12*d*. As such, table top 12 may be comprised of one piece.

In a preferred embodiment, table top 12 is preferably circular and is comprised of in whole or part of metal. Preferably, both first portion 12*c* and second portion 12*d* are comprised of metal. Additionally, second portion 12*d* is preferably of sufficient diameter to not fall through table top opening 20. In this regard, second portion 12*d* may be of slightly greater diameter than table top opening 20. In other embodiments, the second portion 12*d* may be of any other material. In yet other embodiments, any other means of preventing second portion 12*d* from falling through table top opening 20 may be used. In yet other embodiments, table top, first portion of table top, and/or second portion of table top may not be circular, and may be any other shape.

Figure 8:
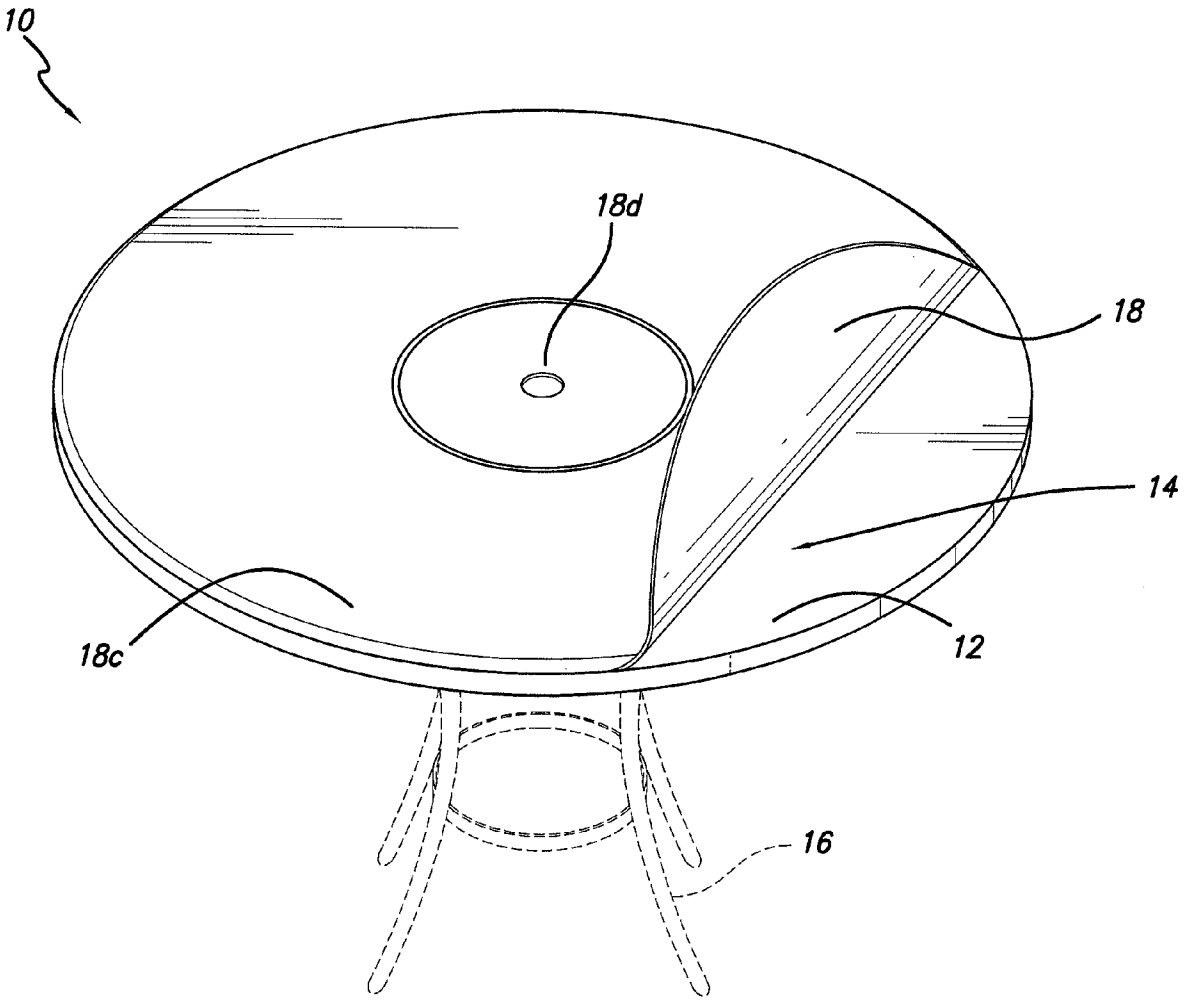
FIG. 8 is a perspective view of the table system of FIG. 1.

In a preferred embodiment, and as best seen in FIG. 8, the table system 10 includes a surface covering 18 which covers substantially all of the upper surface 14 of the table top 12. Preferably, the surface covering 18 includes a first portion 18*c* and a second portion 18*d* which are separable from each other. The first portion 18*c* preferably includes a surface covering opening 22 (as used herein, the numerical identifier "22" refers to a plurality of table top openings, i.e., at least one). Removal of the second portion 18*d* exposes the surface covering opening 22, as best seen in FIG. 1. In other embodiments, the surface covering 18 may not include second portion 18*d*.

In a preferred embodiment, the table top opening 20 and the surface covering opening 22 are concentric and have substantially similar diameters. Preferably, the table top opening 20 and the surface covering opening 22 are circular. In other embodiments, the table top opening 20 and/or the surface covering opening 22 may be of any shape, i.e., oval, circular, rectangular, or the like. In yet other embodiments, the table top opening 20 and the surface covering opening 22 may not be concentric. In this regard, the table top opening 20 and the surface covering opening 22 may be of different diameters and/or one opening may partially obstruct the other. In other embodiments, table system 10 may not include table top opening 20 and/or may not include surface covering opening 22.

In a preferred embodiment, the table top opening 20 and the surface covering opening 22 each have substantially similar diameters of at least about 2 inches to 60 about inches. In a more preferred embodiment, the table top opening 20 and the surface covering opening 22 each have substantially similar diameters of at least about 3 inches to about 12 inches. In a highly preferred embodiment, the table top opening 20 and the surface opening 22 each have substantially similar diameters of at least about 3 inches to about 10 inches. In other embodiments, the diameter of each of the table top opening 20 and the surface covering opening 22 may be more than about 60 inches or less than 2 inches.

In a preferred embodiment, and as seen in FIGS. 1-11, the table top opening 20 is located in the center, or substantially in the center of, the table top 12. In other embodiments, the table top opening 20 may not be located in the center, or substantially in the center, of the table top 12. For example, the table top opening 20 may be close to an edge of the table top 12 and/or may be located on one side of the table top 12. Preferably, the location of the table top opening 20 will dictate the location of the surface covering opening. In other embodiments, the table top 12 may swivel and/or bucket 24 may be located on an edge.

Figure 4:
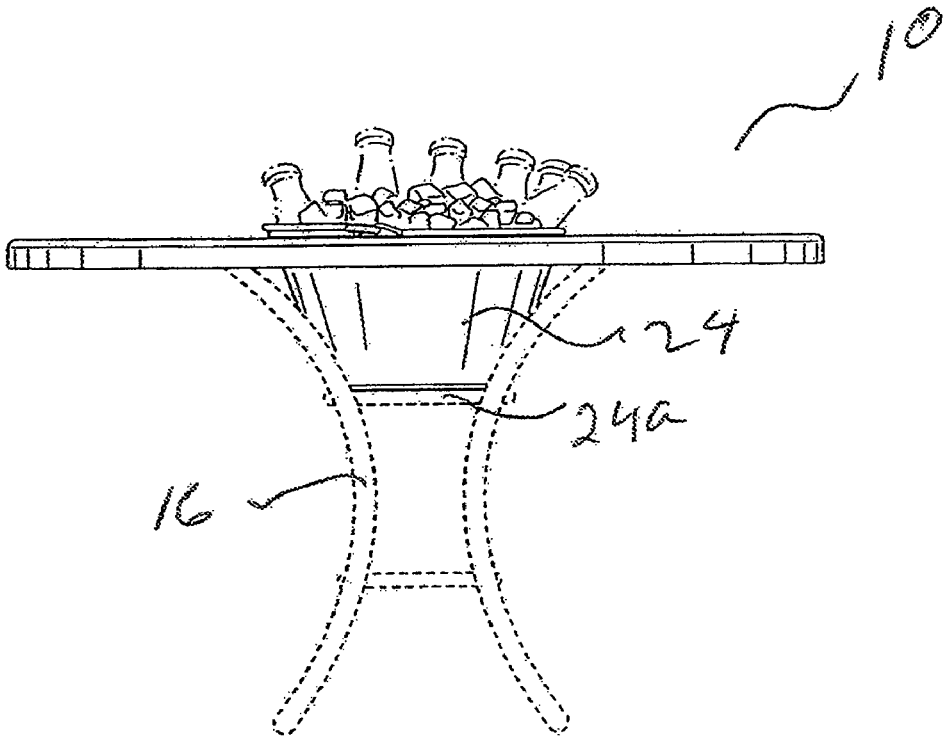
FIG. 4 is a side elevational view of the table system of FIG. 1.
Figure 5:
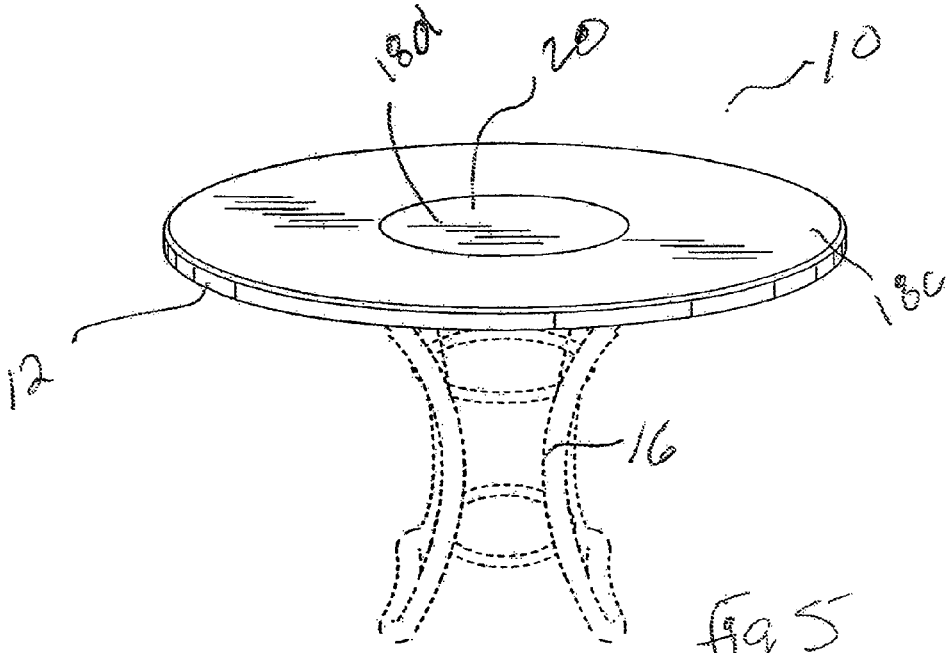
FIG. 5 is a perspective view of a table system of FIG. 1.
Figure 6:
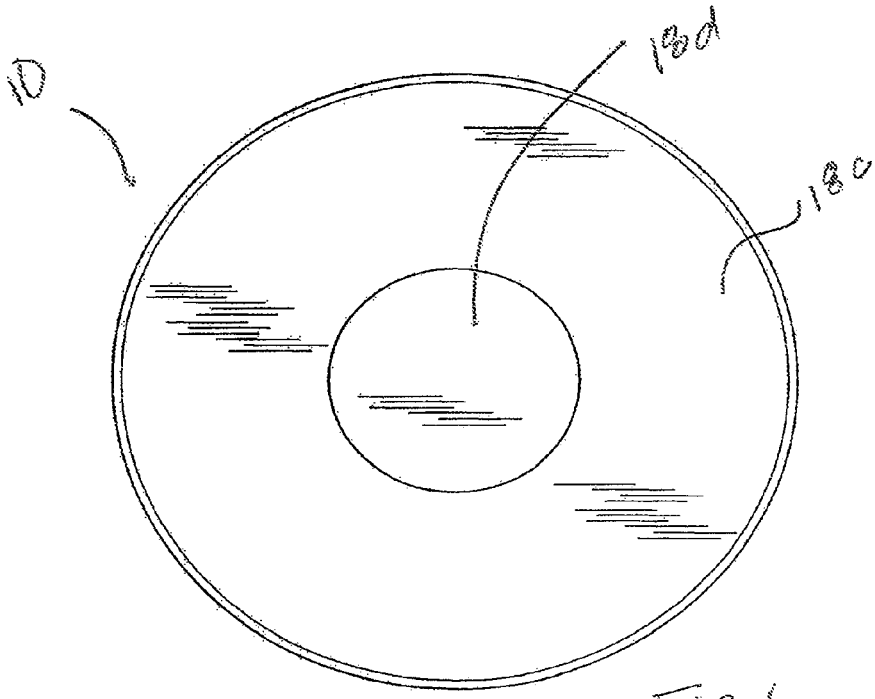
FIG. 6 is a top view of the table system of FIG. 1.
Figure 7:
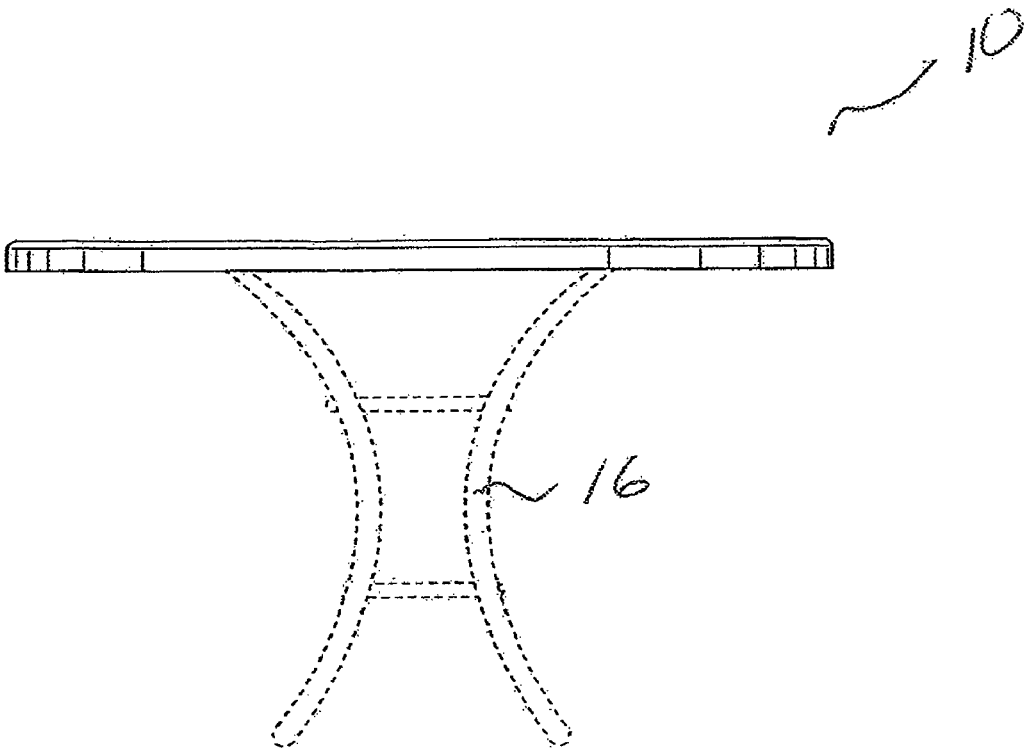
FIG. 7 is a side elevational view of the table system of FIG. 1.

In a preferred embodiment, and as seen in FIGS. 1-4 and 9, the table system 10 includes a bucket 24. Preferably, and as best seen in FIG. 4, the bucket 24 has a bottom 24*a* which has a smaller diameter than the diameter of the table top opening 20. In other embodiments, the diameter of the bucket 24 may not be smaller than the diameter of the table top opening 20. In yet other embodiments, the table system 10 may include more than one bucket or may not include a bucket. In other embodiments, the table system 10 may include another suitable object adapted for holding commercial items such as beer bottles.

In a preferred embodiment, and as best seen in FIG. 10, the table system 10 may include a bucket holder 30 for supporting the bucket 24. In other embodiments, the table system 10 may include any other means of holding the bucket, or the like, or may not include the holder 30. For example, the diameter of the bucket 24 (for example the diameter of a top edge of the bucket 24), may be slightly larger than the diameter of the table top opening 20. In this manner, the bucket 24 will be held in place.

Figure 9:
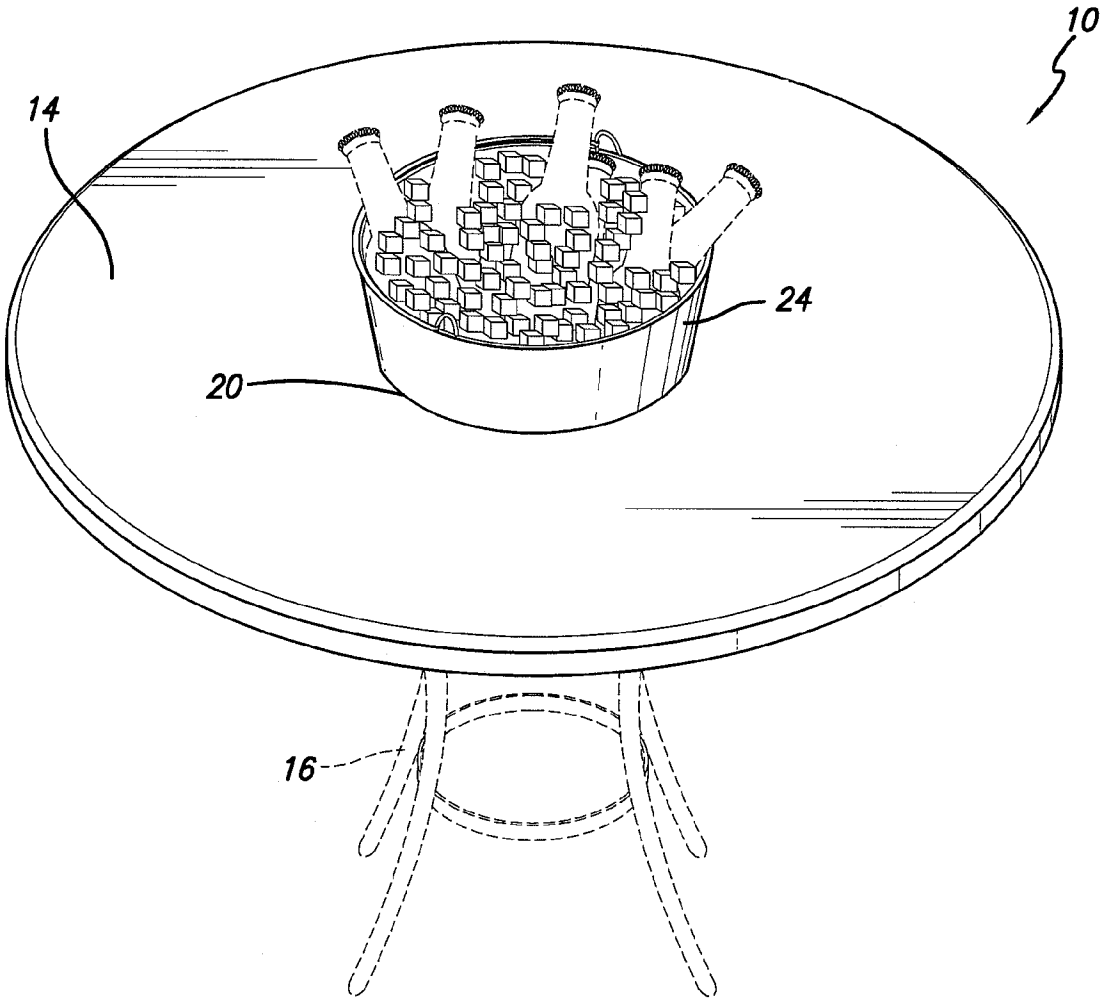
FIG. 9 is a perspective view of the table system of FIG. 1.

In a preferred embodiment, and as seen in FIGS. 1-4 and 9, the bucket 24 of the table system 10 is large enough to hold at least three small bottles of beer and ice sufficient to keep the beer cold for a period of time. Additionally, as best seen in FIG. 9, the bucket 24 is removable. In yet other embodiments, the bucket 24 may hold any other commercial item, such as soft drinks, or the like, or may be empty.

In a preferred embodiment, and as best seen in FIG. 1, the upper surface 14 of table top 12 has an ornamental design on its surface. Preferably, the ornamental design depicts beer bottles and/or depicts other promotional items related thereto. For example, the ornamental design may be related to football, tailgating, alcohol, or the like. Preferably, the upper surface 14 and the surface covering 18 each have ornamental designs promoting and/or marketing the same or similar product and/or brand of product, i.e., beer and/or a particular brand of beer. In other embodiments, the upper surface 14 may not have an ornamental design on its surface and/or the upper surface 14 and the surface covering 18 may depict different products. In yet other embodiments, the surface covering 18 may not have an ornamental design, i.e., may be solid or the like.

In a preferred embodiment, and as seen in FIG. 1, the surface covering 18 includes a table-facing surface 18*a*. Preferably, the table-facing surface 18*a* of surface covering 18 and the upper surface 14 of table top 12 are each comprised in whole or part, of a magnetic material, such as nickel, iron, cobalt, gadolinium, their alloys, and the like. This allows for the surface covering 18 and upper surface 14 of the table to top 12 to removeably attach to one another. In other embodiments, the table-facing surface 18*a* of the surface covering 18 and the upper surface 14 of the table top 12 may be removeably attached to each other by other means. For example, the table-facing surface 18*a* of the surface covering 18 may have an adhesive for removeably attaching to the upper surface 14 of the table top 12. Additionally, the second portion 18*d* of the surface covering 18 may or may not be comprised of a magnetic material.

In a preferred embodiment, the table system 10 is of bar height or patio height. In other embodiments, the table system 10 may be of any height. For example, the table system 10 may not have legs and may be substantially on the ground.

In a preferred embodiment, the methods of the present invention include promoting beer products, or other commercial items, by depicting ornamental designs related to their marketing on the surface of a table. The methods may also include providing a removable surface covering also depicting ornamental designs related to marketing of the beer products. These surface coverings may be replaced with new ones after a period of time to market the beer products in different ways. As such, a new table does not need to be purchased. Furthermore, the methods may include providing a bucket having the very beer product marketed inside of the bucket itself. The foregoing methods allow for consumers to be constantly stimulated with the beer product marketed, causing them to purchase more. Additionally, the use of a bucket saves space on the table.

While certain embodiments of the invention have been described, these embodiments have been presented by way of example only, and are not intended to limit the scope of the inventions. Indeed, the novel methods and elements described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A table system comprising:

a table top having an upper surface that includes first advertising indicia thereon, the table top having an opening defined therein, wherein the table top and the opening are concentric, and wherein the table top includes a removable center cover that covers the opening therein, at least three legs depending downwardly from the table top, wherein the at least three legs each have an inwardly directed arcuate shape, a ring positioned below the opening in the table top, whereby a bucket of a certain size received in the opening in the table top is supported by the ring, wherein the ring has an outer surface that is connected to an inner surface of each of the at least three legs, and wherein the ring is concentric with the table top and the opening therein, and a removable surface covering layer that covers substantially the upper surface of the table top, wherein the surface covering layer has a lower surface that comprises a magnetic material and an upper surface with second advertising indicia thereon, wherein the surface covering layer is magnetically secured to the upper surface of the table top, wherein the surface covering layer includes an opening therein that surrounds a removable center portion that is magnetically secured to the upper surface of the removable center cover of the table top.

2. The table system of claim 1 further comprising a second removable surface covering layer that is configured to cover substantially the upper surface of the table top and has an upper surface with advertising indicia thereon and a lower surface that comprises a magnetic material.

3. The table system of claim 1 further comprising a bucket having a top and a bottom each having a diameter, wherein the diameter of the opening in the table top is larger than the diameter of the bottom of the bucket and smaller than the diameter of the top of the bucket.

4. The table system of claim 1 wherein a portion of the advertising indicia on the surface covering layer is disposed on the removable center portion.

5. The table system of claim 1 wherein the first advertising indicia and the second advertising indicia are different.

* * * * *